US007055558B1

(12) United States Patent
McGill et al.

(10) Patent No.: US 7,055,558 B1
(45) Date of Patent: Jun. 6, 2006

(54) PHASE 1 CONTAINMENT SUMP SYSTEM FOR PETROLEUM FUELING FACILITY UNDERGROUND STORAGE TANKS

(76) Inventors: M. Daniel McGill, 1579 Hidden Canyon Rd., La Habra Heights, CA (US) 90631; Thompson W. Wyper, 1159 W. Fern Dr., Fullerton, CA (US) 92833

( * ) Notice: Subject to any disclaimer, the term of this patent is extended or adjusted under 35 U.S.C. 154(b) by 100 days.

(21) Appl. No.: 10/679,988

(22) Filed: Oct. 6, 2003

Related U.S. Application Data

(60) Provisional application No. 60/416,116, filed on Oct. 4, 2002.

(51) Int. Cl.
*B85B 1/04* (2006.01)

(52) U.S. Cl. ..... 141/86; 137/312

(58) Field of Classification Search ..... 141/86; 405/52–55; 137/312, 371; 220/86.1
See application file for complete search history.

(56) References Cited

U.S. PATENT DOCUMENTS 4,960,346 A * 10/1990 Tamayo ..... 405/52
5,058,633 A * 10/1991 Sharp ..... 141/86
5,186,577 A * 2/1993 Reicin et al. ..... 405/52
6,171,029 B1 * 1/2001 McGill et al. ..... 405/249

* cited by examiner

*Primary Examiner*—Timothy L. Maust
(74) *Attorney, Agent, or Firm*—Christie, Parker & Hale, LLP

(57) ABSTRACT

A containment system for a fuel site according to the present invention comprises: a fuel storage tank; at least one fuel line connected to the fuel storage tank; a containment sump associated with the fuel storage tank and encircling the at least one fuel line connected to the fuel storage tank; an opening in the containment sump through which external connections may be made with a remote end of the at least one fuel line; and a removable catch basin adapted to fit into the opening in the containment sump and to fit over and around the remote end of the at least one fuel line such that the catch basin can catch fuel spills from the remote end of the at least one fuel line.

24 Claims, 15 Drawing Sheets

PHASE 1 VAPOR RECOVERY

VAPOR RELEASE FROM NOZZLE CONNECTION

PHASE 1 CONTAINMENT SUMP SYSTEM FOR PETROLEUM FUELING FACILITY UNDERGROUND STORAGE TANKS

CROSS-REFERENCE TO RELATED APPLICATION(S)

This application claims priority to the U.S. provisional application No. 60/416,116, filed Oct. 4, 2002.

FIELD OF THE INVENTION

The present invention relates to containment sump systems for containing spillage of gasoline dispensed to underground storage tanks at filling stations and preventing overfilling of the underground storage tanks.

BACKGROUND

Gasoline and other petroleum based fuels are dispensed to motorists and other users from underground storage tanks (USTs). The USTs are filled periodically from tanker fuel trucks with hoses connected to the fill port (or fuel drop tube) and in most cases, an additional hose is used to vent the vapors displaced from the UST as the fuel level rises back to the tanker truck to form a closed loop system. The process of UST filling and vapor recovery is called Phase 1 vapor recovery, as shown in FIG. 1.

To minimize the potential of fuel spilled from the fuel delivery process entering the surrounding area or soil, as shown in FIG. 2, a spill containment sump 20 (commonly referred to as a "spill bucket") is used to hold any fuel splashed or drained from the fuel transfer hose. Fuel collected in the spill containment sump 20 is typically drained back into the drop tube unit 21 through a valve 22 operated by the delivery driver.

Spill containment units can be either the direct burial or the containment sump type. Overall, the petroleum industry is shifting towards constructing spill containment systems with tank top containment sumps, as shown in FIG. 5, because they provide an additional level of leak protection. One application of the present invention involves an integrated tank top containment sump spill containment system.

In addition, USTs are typically equipped with an overfill protection device to prevent excess fuel from being delivered to the tank. These devices fall into two categories, ball floats and flapper valves. Ball float devices, as shown in FIG. 3, are installed in the UST vapor vent line 24. As the fuel level rises, a floating ball 25 rises up and eventually seals off the escaping vapors, preventing any additional fuel from entering the tank. Flapper valves, as shown in FIG. 2, are installed on the fill pipe 21 (also called the "drop tube"). As the fuel level rises, a float attached to a valve mechanism 23 closes off the flow of fuel.

There are a number of problems with the current state of the art of spill containment and overfill protection devices. A large percentage of recently installed spill containment devices fail periodic leak testing. Also, a number of overfill prevention devices fail vapor integrity tests and frequently have mechanical problems that prevent accurate and reliable overfill protection. Also, current spill containment sumps are difficult to properly install and service.

Another problem with current Phase I UST fueling devices is the inability of the vapor piping system to completely contain UST ullage vapors. If the UST is exposed to excess pressure, fuel vapors can escape out of the vent vapor connection while the hose nozzle is being connected to the poppet adaptor by the delivery truck driver. This is both a potential exposure risk to the delivery truck driver, as shown in FIG. 4, and a source of fugitive emissions of volatile fuel vapors 26. The various embodiments of the present invention represent a significant improvement over existing Phase I vapor recovery, overfill protection and spill containment systems.

SUMMARY OF THE INVENTION

A containment system for a fuel site according to the present invention comprises: a fuel storage tank; at least one fuel line connected to the fuel storage tank; a containment sump associated with the fuel storage tank and encircling the at least one fuel line connected to the fuel storage tank; an opening in the containment sump through which external connections may be made with a remote end of the at least one fuel line; and a removable catch basin adapted to fit into the opening in the containment sump and to fit over and around the remote end of the at least one fuel line such that the catch basin can catch fuel spills from the remote end of the at least one fuel line.

In one embodiment, the containment system according to the present invention also comprises a removable drip cap placed over and around the at least one fuel line and extending between the at least one fuel line and the removable catch basin such that fuel cannot drip down between the at least one fuel line and the removable catch basin into the containment sump. In a further embodiment, the removable catch basin comprises an upwardly extending side wall, and an upwardly extending inner wall lower than the side wall that encircles but is spaced from the at least one fuel line, and wherein the drip cap extends from the at least one fuel line over the inner wall of the catch basin but is spaced from a top edge of the inner wall such that the fuel filling the catch basis can drain into the containment sump. The catch basin may also comprise a drain and a drain line connected to the at least one fuel line in yet a further embodiment.

The present invention is directed in one embodiment to a tank top containment sump assembly for containing gasoline spilled during the filling of underground storage tanks at fueling facilities and/or for preventing the overfilling of the storage tanks.

The present invention in one embodiment also provides an improved method and device for filling underground storage tanks, preventing overfill of the storage tanks, and/or for containing spillage during the filling of the storage tanks.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
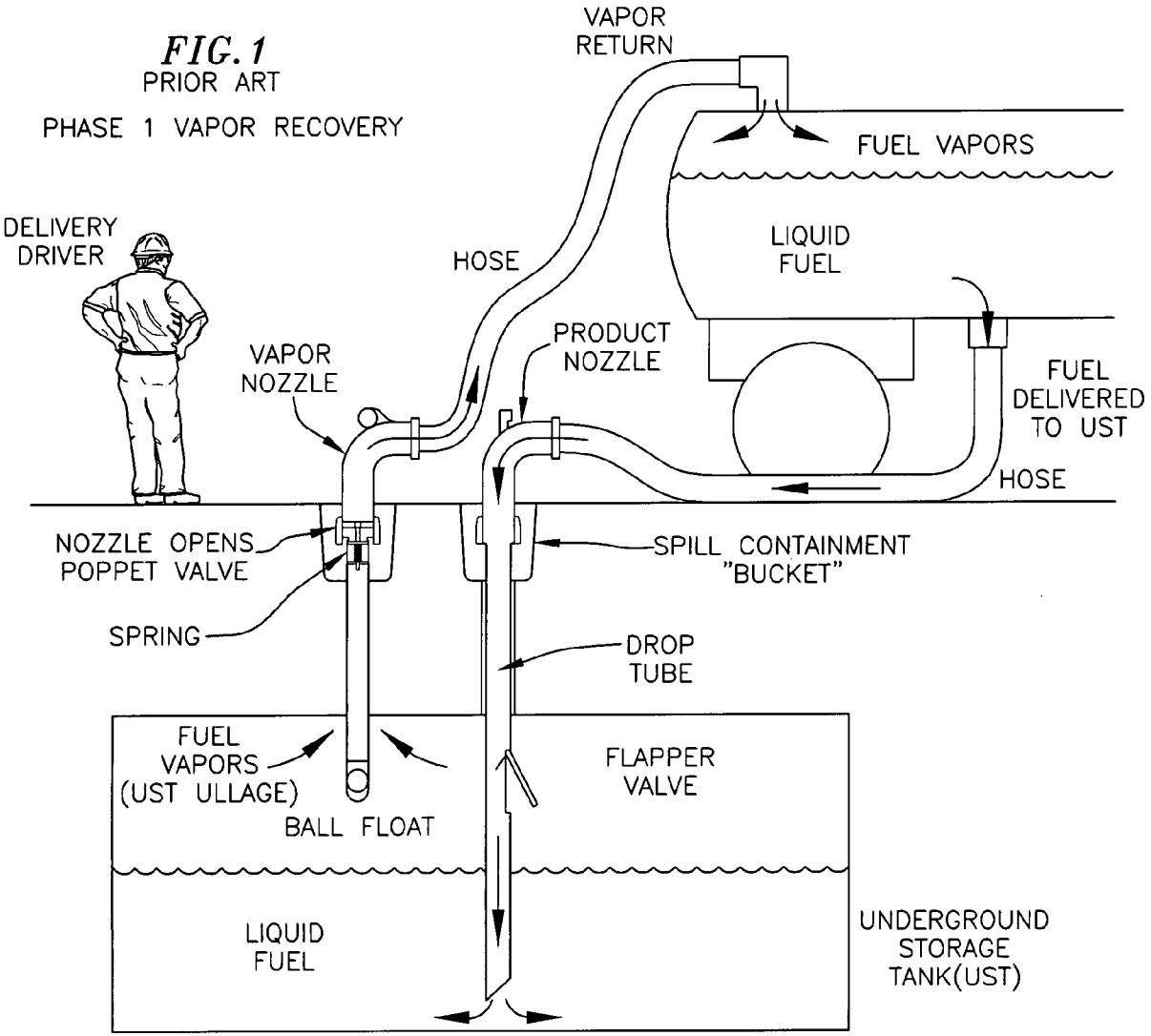
FIG. 1 PRIOR ART
FIG. 1 is a schematic depicting Phase I vapor recovery.
Figure 2:
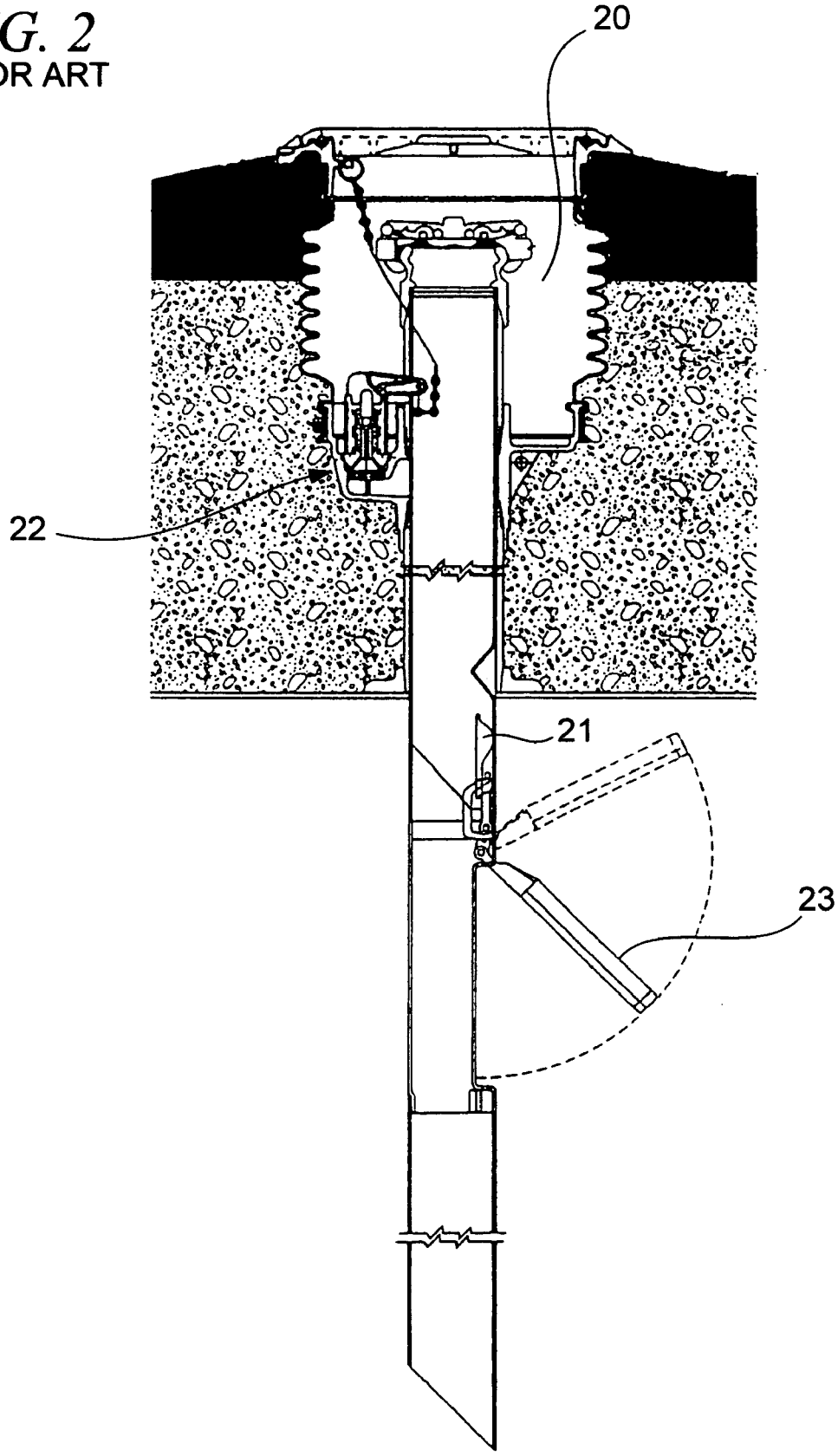
FIG. 2 PRIOR ART
FIG. 2 is a schematic depicting a typical spill containment system with a flapper valve overfill protection device.
Figure 3:
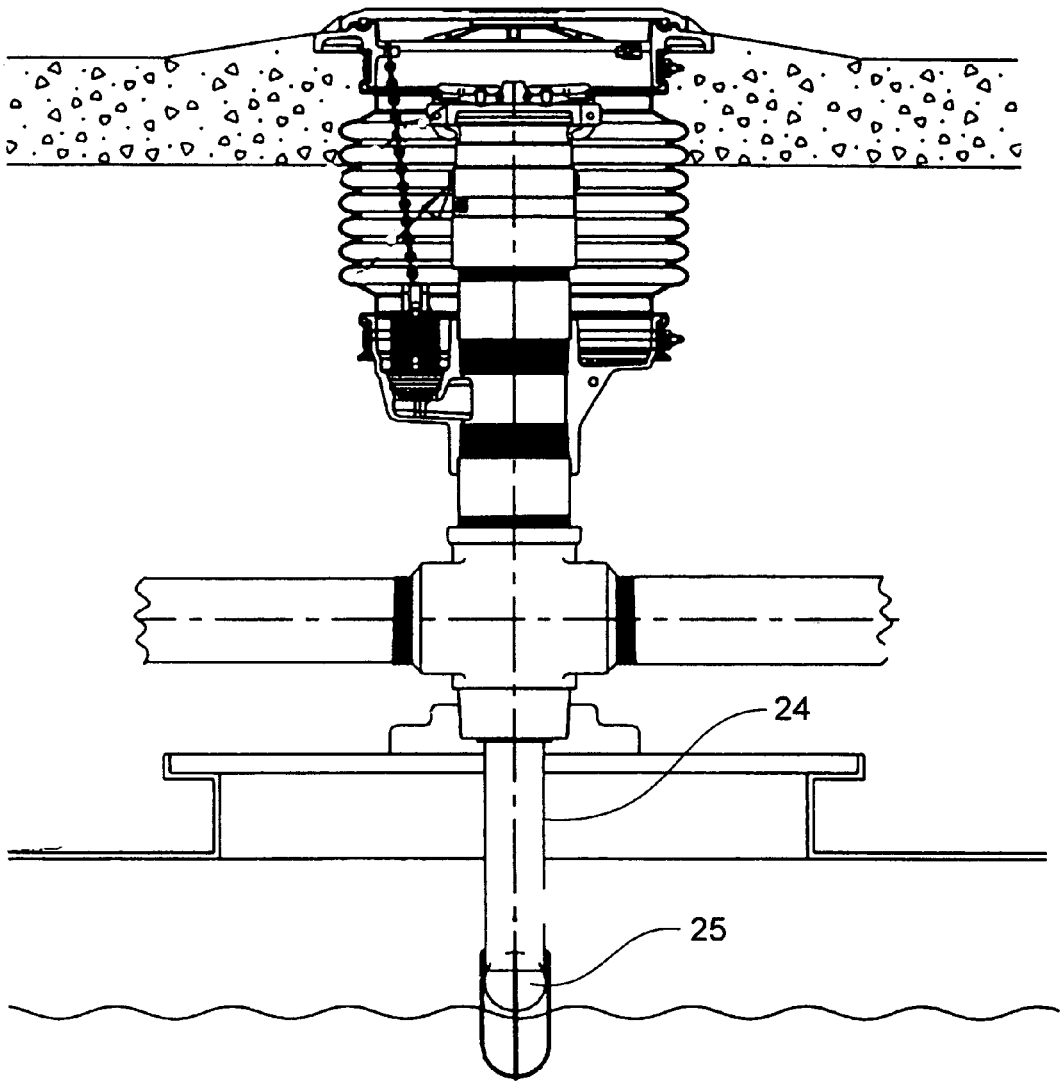
FIG. 3 PRIOR ART
FIG. 3 is a schematic depicting a typical ball float overfill protection device.
Figure 4:
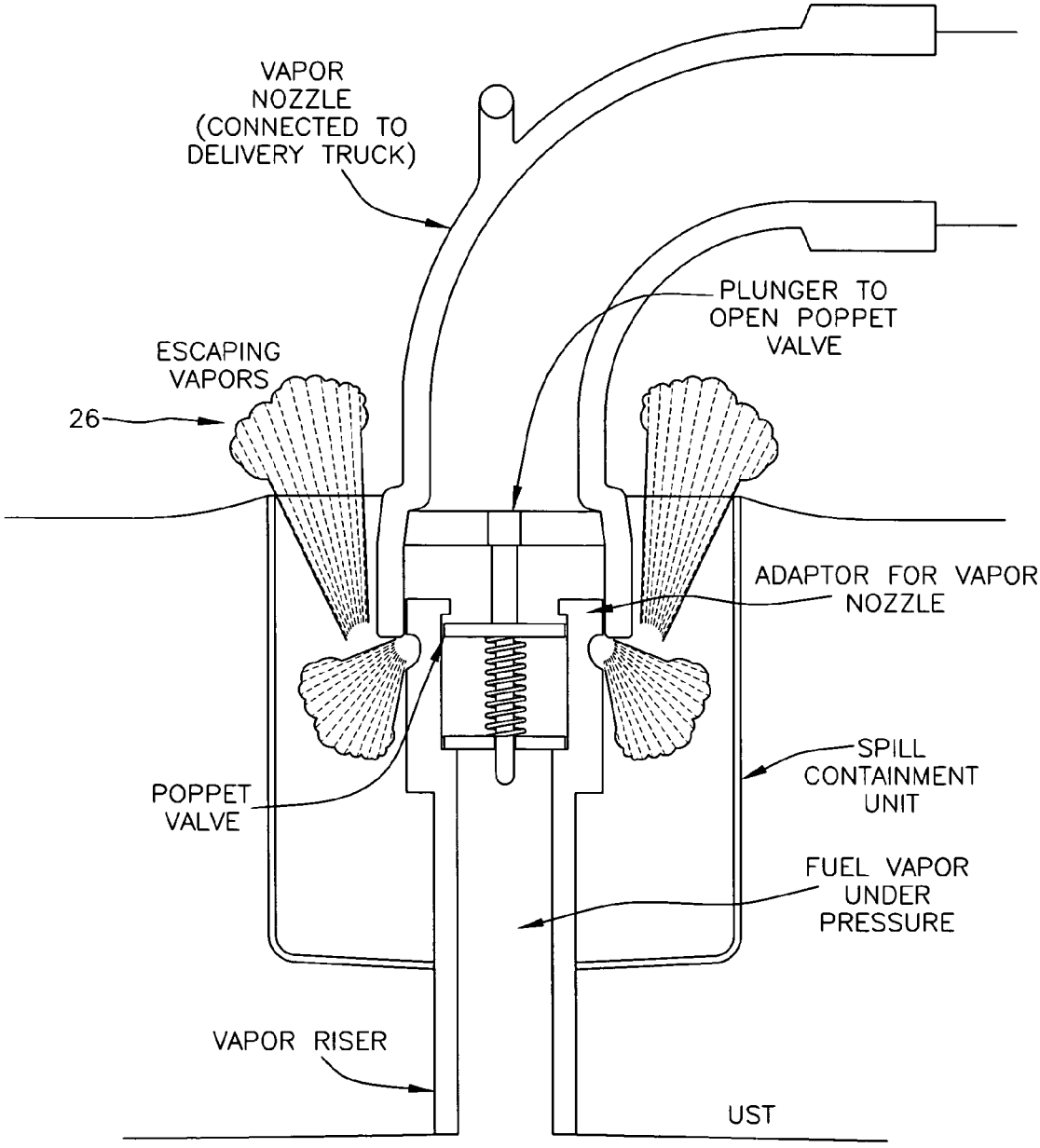
FIG. 4 PRIOR ART
FIG. 4 is a schematic depicting vapor released from a nozzle connection.
Figure 5:
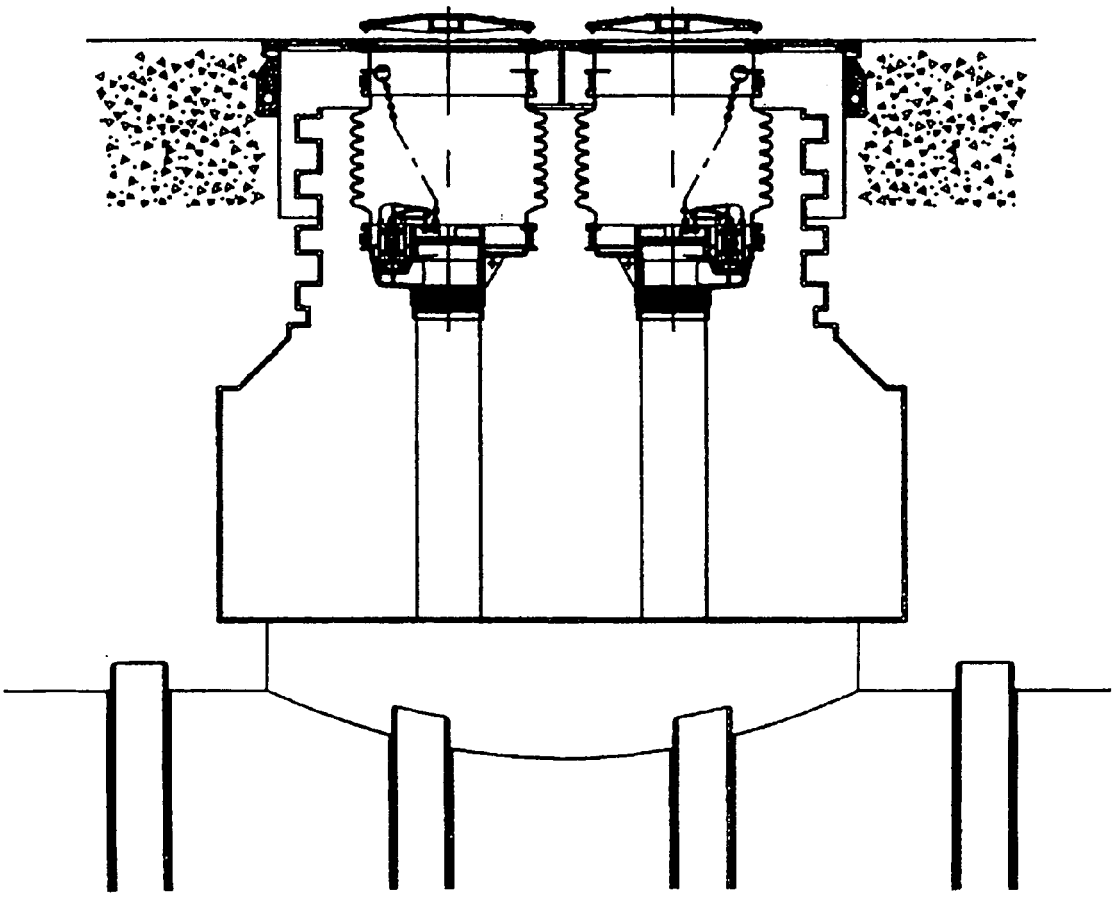
FIG. 5 PRIOR ART
FIG. 5 is a schematic depicting a typical spill containment system utilizing a tank top containment sump.
Figure 6A:
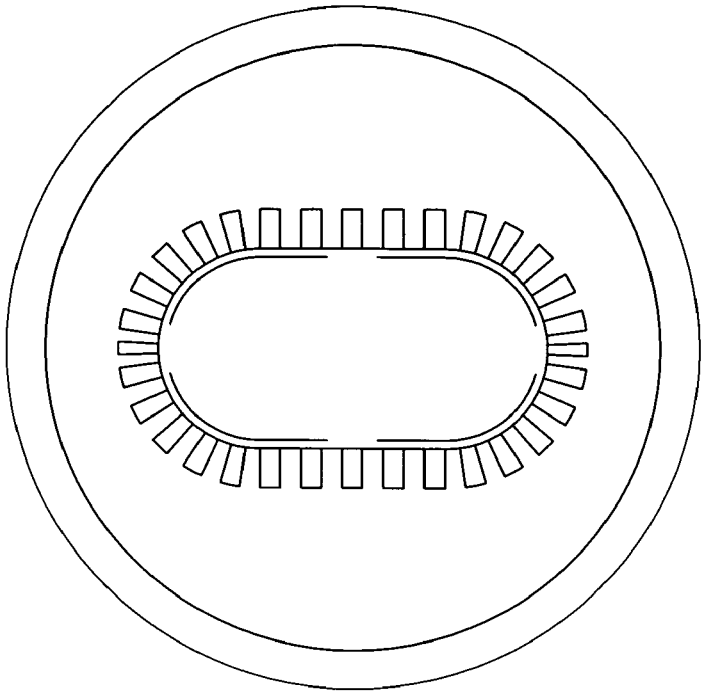
FIG. 6A PRIOR ART
FIG. 6A is a top schematic of a cover for a containment sump.
Figure 6B:
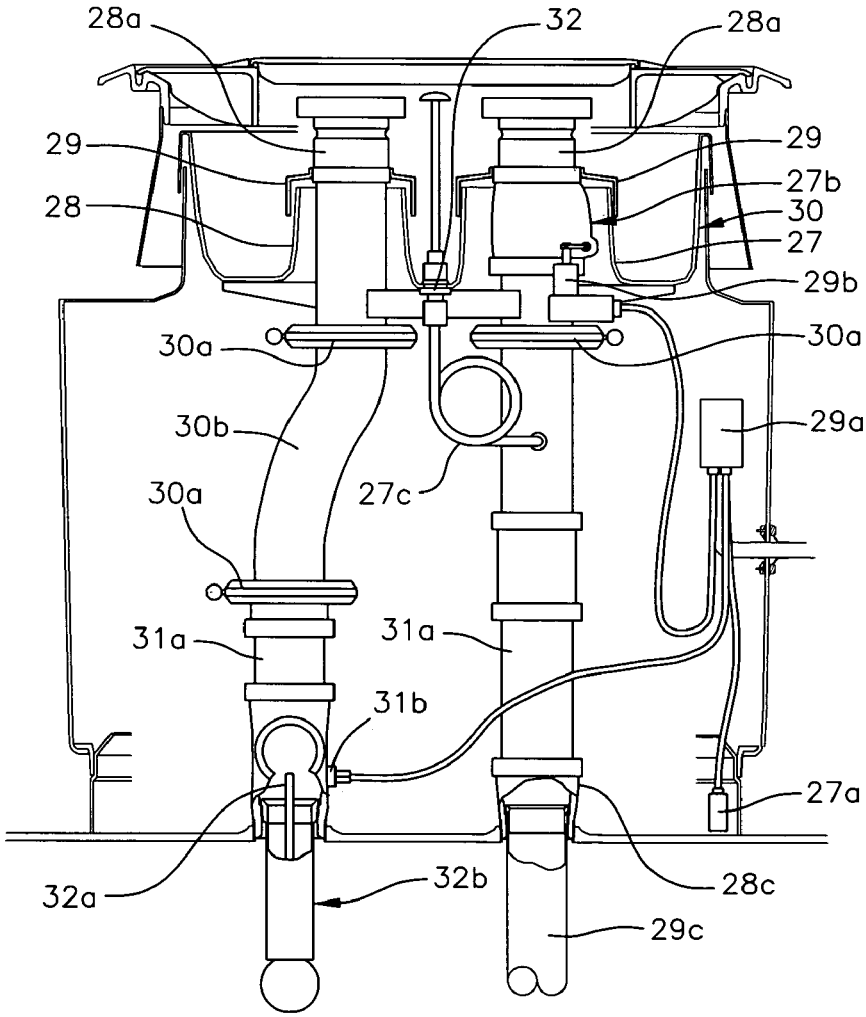
FIG. 6B is a side schematic depicting the general assembly of one embodiment of the present invention.

In one embodiment, as shown in FIG. 6B, a tank top containment sump assembly is a continuous shape with two round upwardly protruding openings, one for a fuel delivery line 27, and the other for a vapor riser connection 28. Threaded onto each riser is a connection adaptor 28*a* for delivery tanker truck nozzles. Installed below the connection adaptors are drip caps 29. There is a seal between the adaptor and the drip cap. The drip cap is installed so that any fuel running down from the adaptor is directed into a containment reservoir or catch basin 30. The drip caps are also designed for removal without disassembly of the riser adaptors to assist with rapid removal of the spill containment unit. The spill containment reservoir is installed beneath the drip cap so the shoulder of the drip cap overlaps the wall of the containment reservoir while leaving a gap to ensure spillage in excess of the reservoir's capacity is drained into the containment sump. The containment reservoir contains a drain valve 32 to drain spillage from the reservoir into the underground storage tank.

Figure 8:
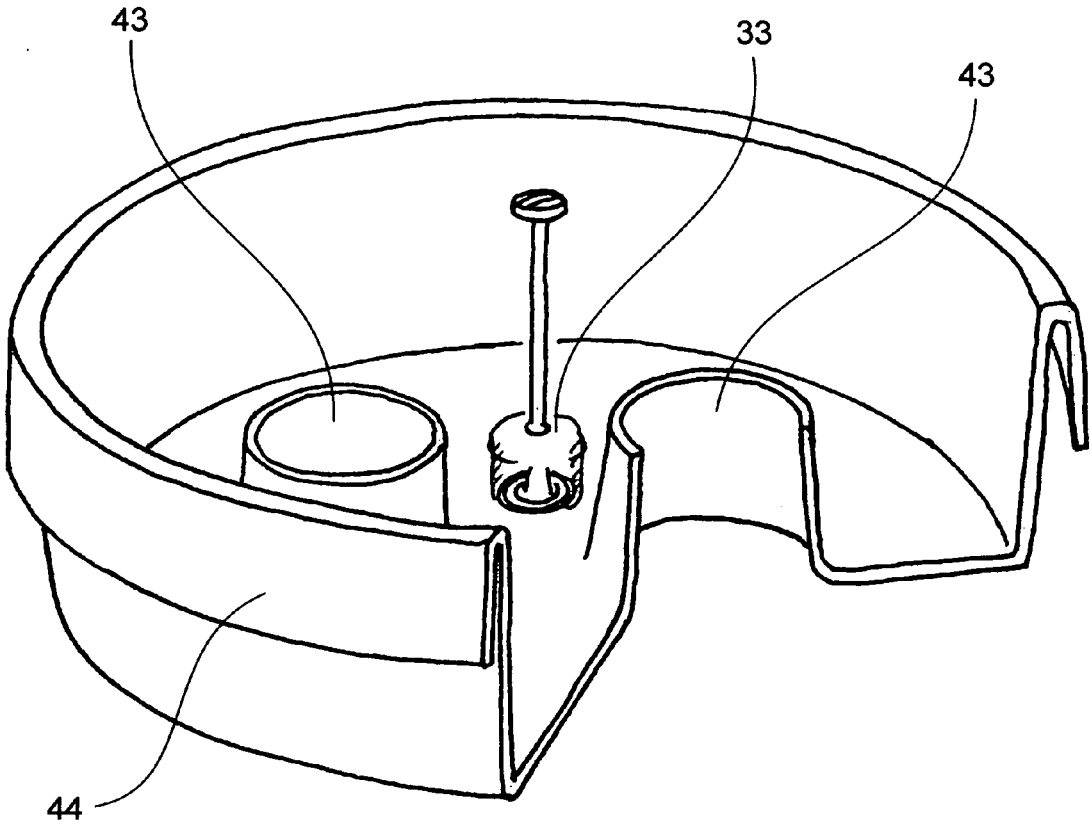
FIG. 8 is a perspective view, partly in section, of a spill containment basin.

In the assembly or disassembly of this embodiment of the present invention, there is provided a reservoir or catch basin for collecting and containing fuel from a UST filling event of a continuous shape with two round openings protruding upwardly from the center of the basin, as shown in FIG. 8. The two openings 43 serve to allow the fuel delivery riser and vapor riser passage through the basin. The center of the basin contains an opening 33 through which the sump drain valve system passes. Attached over the openings in the catch basin, as shown in FIG. 6B, are two drip caps 29, one screwed over the vapor riser connection, and the other screwed over the fuel delivery line.

Beneath the vapor riser connection, as shown in FIG. 6B, is an "EZ-Fit" connection 30*a* (a 3A type sanitary fitting) attached to a 4" section of removable flexible piping 30*b*, at the end of which is attached another "EZ-Fit" connection 30*a*. Below the bottommost "EZ-Fit" connection is a threaded pipe section 31*a* for height makeup. Beneath the threaded pipe section is a sensor unit 31*b*, a ball float riser proximity indicator for the sensor 32*a* and a ball float overfill protection device 32*b*. The sensor unit is connected to a j-box 29*a* for an overfill valve and sensor which is connected to a solenoid actuator 29*b*. The j-box is connected to a sump sensor 27*a* located beneath the j-box. The solenoid actuator is attached to a solenoid actuated overfill protection valve assembly 27*b* which is attached beneath the drip cap over the fuel delivery line. Beneath the solenoid actuator is an "EZ-Fit" connection 30*a*. Below the "EZ-fit" connection is attached the drain valve piping 27*c*. Beneath the drain valve piping connection is a threaded pipe section 31*a* for height makeup. Below the threaded pipe section is a vapor tight drop tube assembly 28*c* sealed at the top of the UST. Beneath the drop tube assembly is a drop tube 29*c*. The parts used in the present invention may be made from fiberglass reinforced materials.

Figure 12:
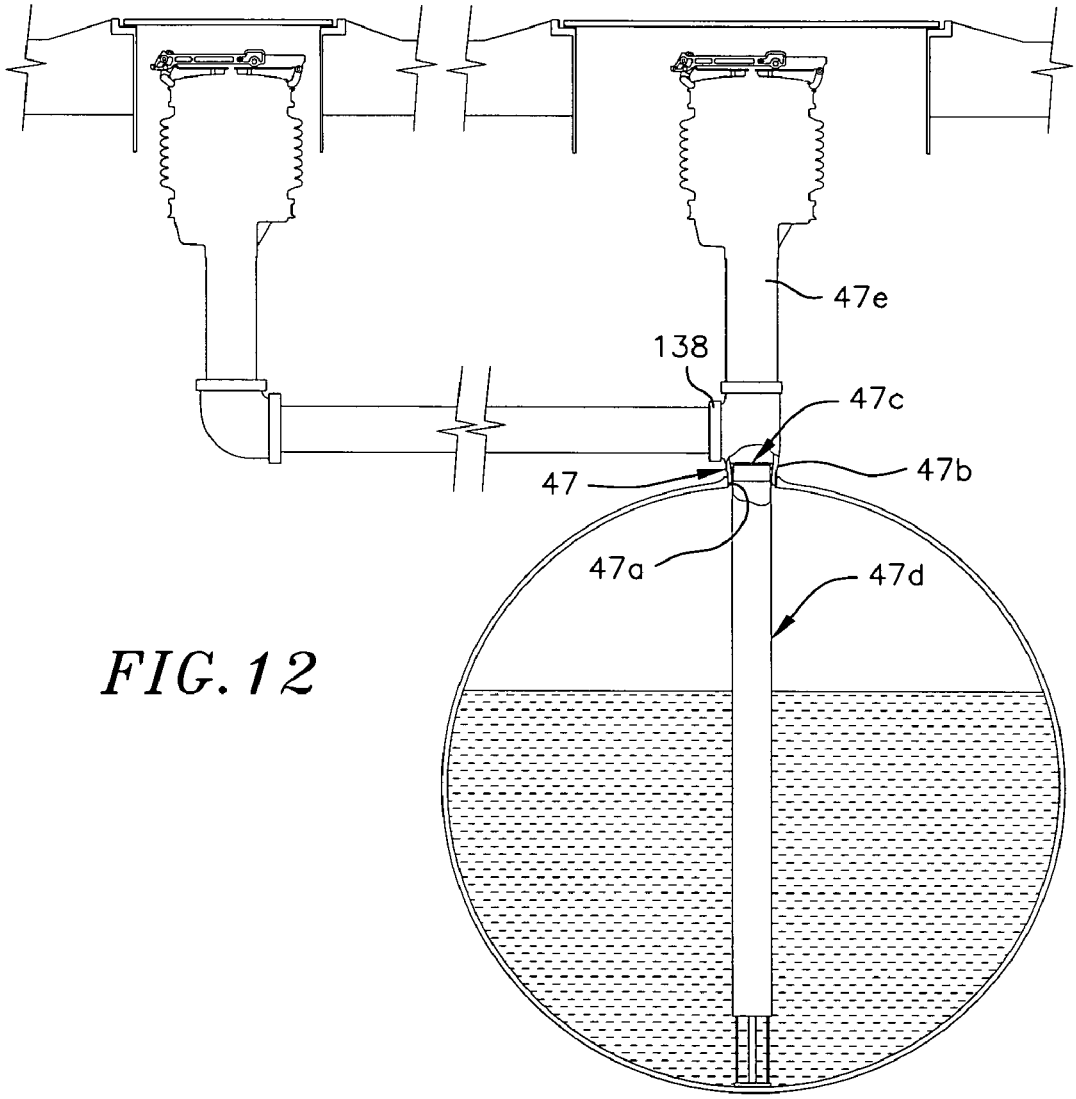
FIG. 12 is a schematic depicting a drop tube seal.

The drop tube sealing assembly, in one embodiment, as shown in FIG. 12, includes a riser tube 47*e* having a proximal end with internal threads and an UST spaced apart from the proximate end of the riser tube. The UST contains a threaded inlet 47*a* which is positioned atop the tank. A standard pipe nipple 47*b*, includes a first end in cooperation with the proximal end, an opposite end in connection with the threaded inlet, and an annular inner surface that forms a conduit. The inner surface comprises a female thread section. A drop tube adapter fitting 47*c* is concentrically disposed within the pipe nipple. The adapter fitting contains an outer surface containing external threads in cooperation with the female thread section. A seal in the form of an O-ring is disposed between the adapter fitting and the pipe nipple. A drop tube 47*d* having an open end is coupled to the adapter fitting.

Figure 9A:
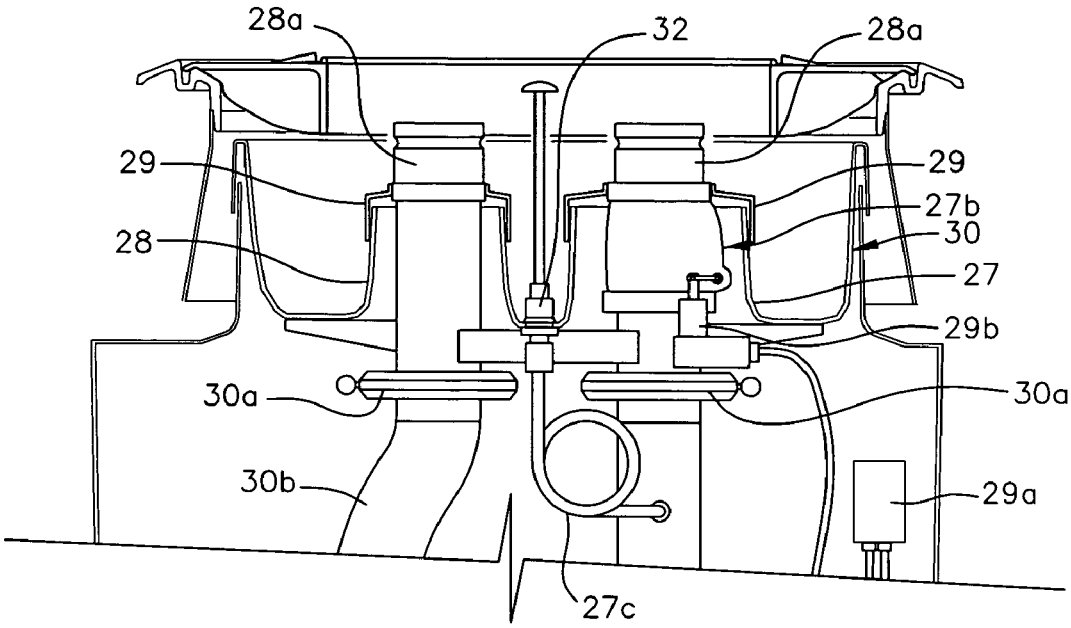
FIGS. 9A–D are schematics depicting a spill bucket disassembly sequence.
Figure 9B:
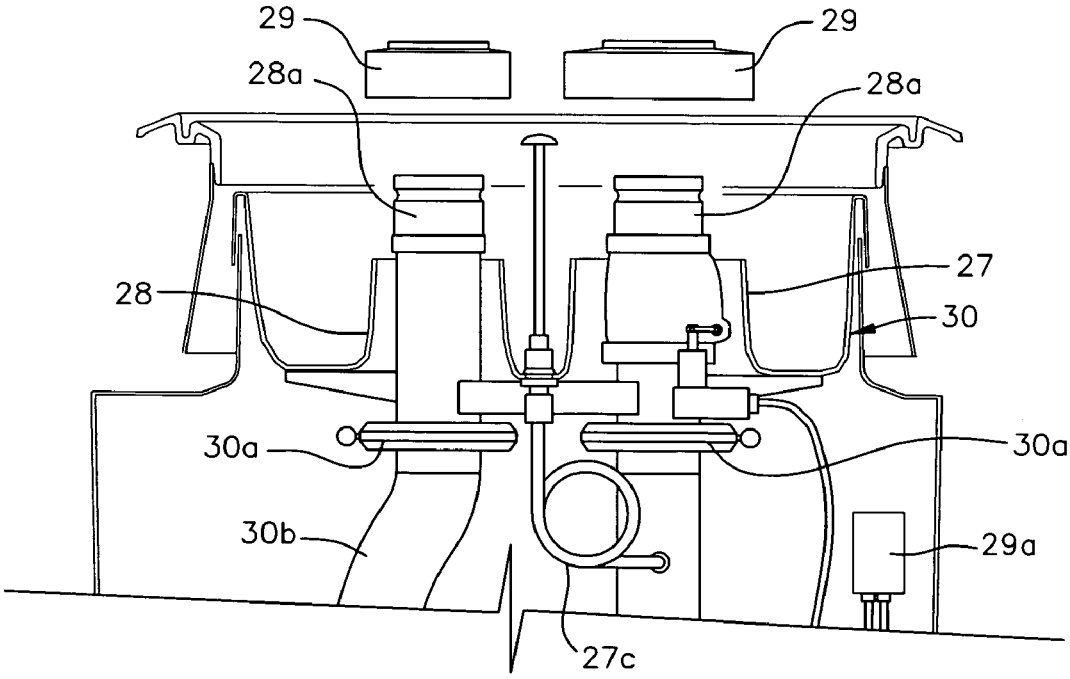
Figure 9C:
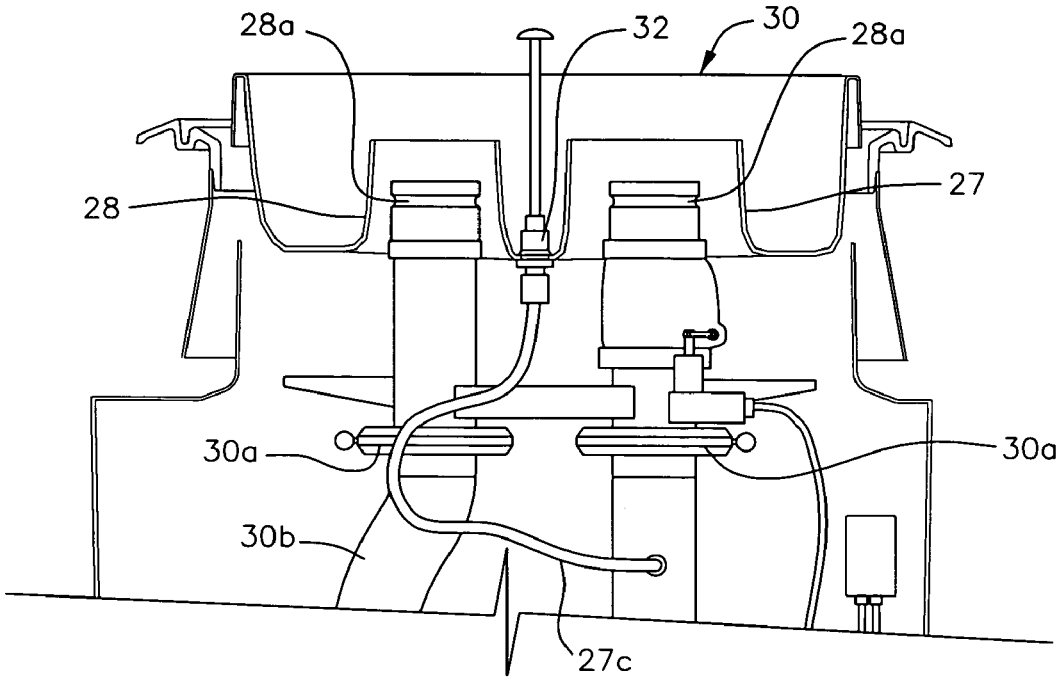
Figure 9D:
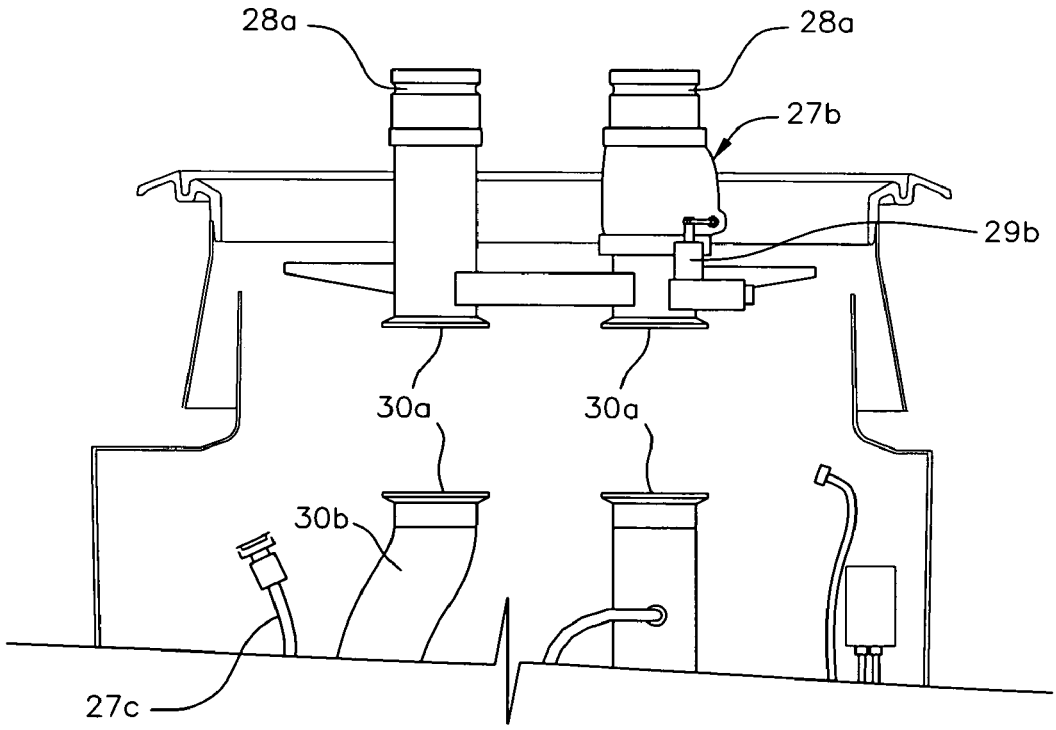

The disassembly of this embodiment of the present invention, as shown in FIGS. 9A–D, begins as shown in FIG. 9B by removing a 36" manway and unscrewing the drip caps from the vapor riser connection and fuel delivery line. After the drip caps are removed, the spill containment basin is lifted up as shown in FIG. 9C using the foot operated drain valve. As the basin is lifted up, the dry break fitting on the drain valve is disconnected and the basin removed. Once the basin is removed, the electrical fitting to the solenoid actuated overfill protection valve is disconnected as shown in FIG. 9D. The two "EZ-Fit" clamp fittings are then removed, and the vapor and fill risers are then removed. This disassembly sequence can require less than one minute.

Figure 11:
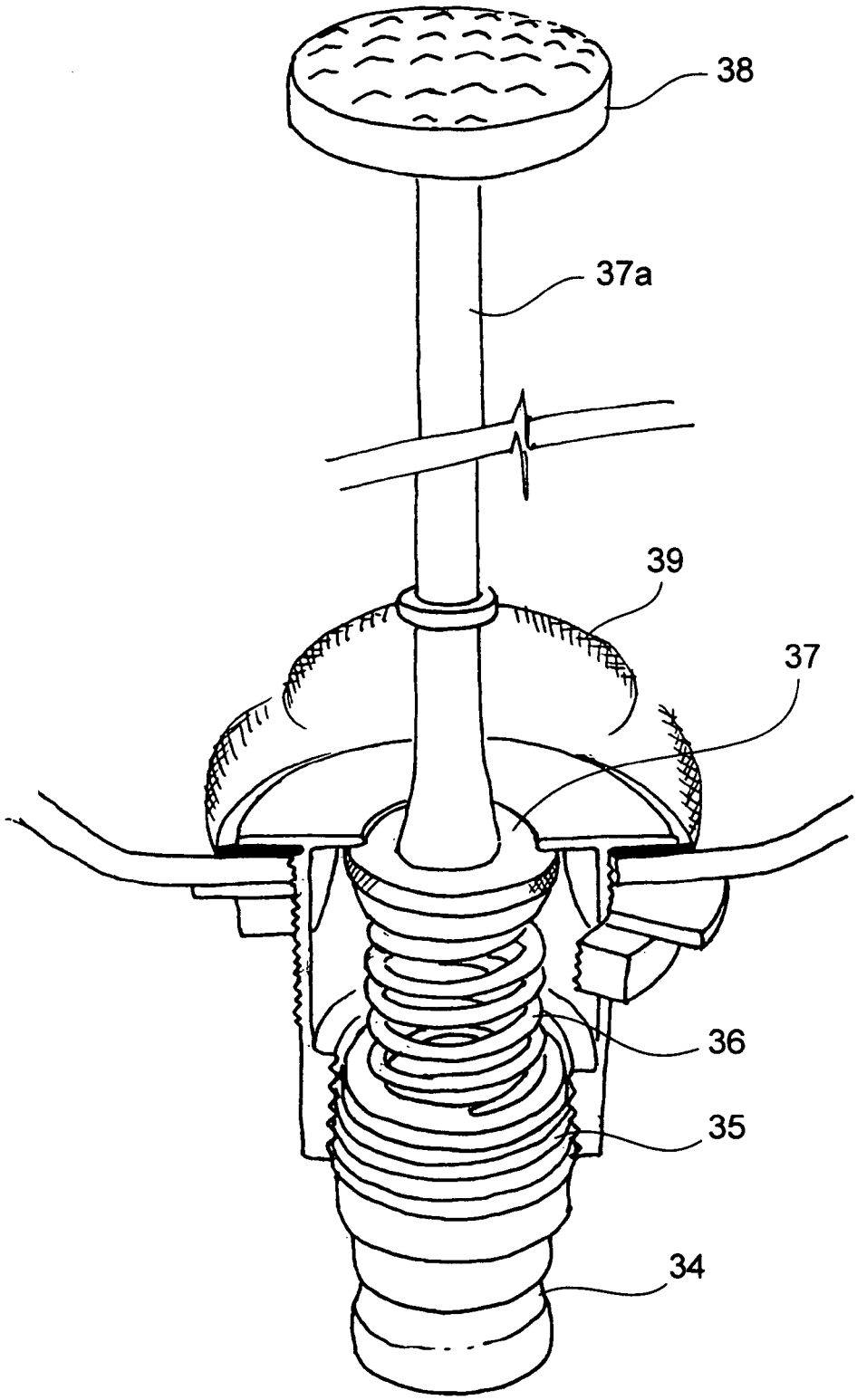
FIG. 11 is a perspective view, partly in section, of a sump drain valve.

To drain the fuel from the spill containment basin into the UST, a drain valve, as shown in FIG. 11, is mounted at the lowest point of the basin. The drain valve comprises a dry break fitting 34, a threaded fitting 35, a compression spring 36, a sealing gasket 37, a connector rod 37*a* and a foot valve pad 38 for manual draining. A float or electronically actuated valve may also be used for draining. The connector rod is connected to the foot pad at one end, and the sealing gasket at the opposite end. Attached to the opposite end of the sealing gasket is the compression spring which is connected at the opposite end to the threaded base. The threaded base is connected at its opposite end to the dry break fitting. To drain fluid from the basin, the operator applies force to the foot valve pad either by sliding laterally or by depressing the pad. Operation of the foot valve pad compresses the spring thereby depressing the sealing gasket, resulting in fluid draining through the opening. A replaceable metal mesh screen filter 39 may be placed around the opening in the basin to prevent debris from entering the drain valve and storage tank. The dry break disconnect fitting facilitates the removal of the spill containment basin.

Passing through the upward open protrusions in the spill containment basin, as shown in FIG. 6B are a fuel delivery riser 27 and a vapor riser 28. Threaded onto each riser is a connection adaptor 28*a* for the delivery tanker truck nozzles. These adaptors allow the tanker truck fuel and vapor connections to be attached to the risers to allow fuel to be delivered to the UST and to allow vapor to be directed to the tanker truck.

Figure 7:
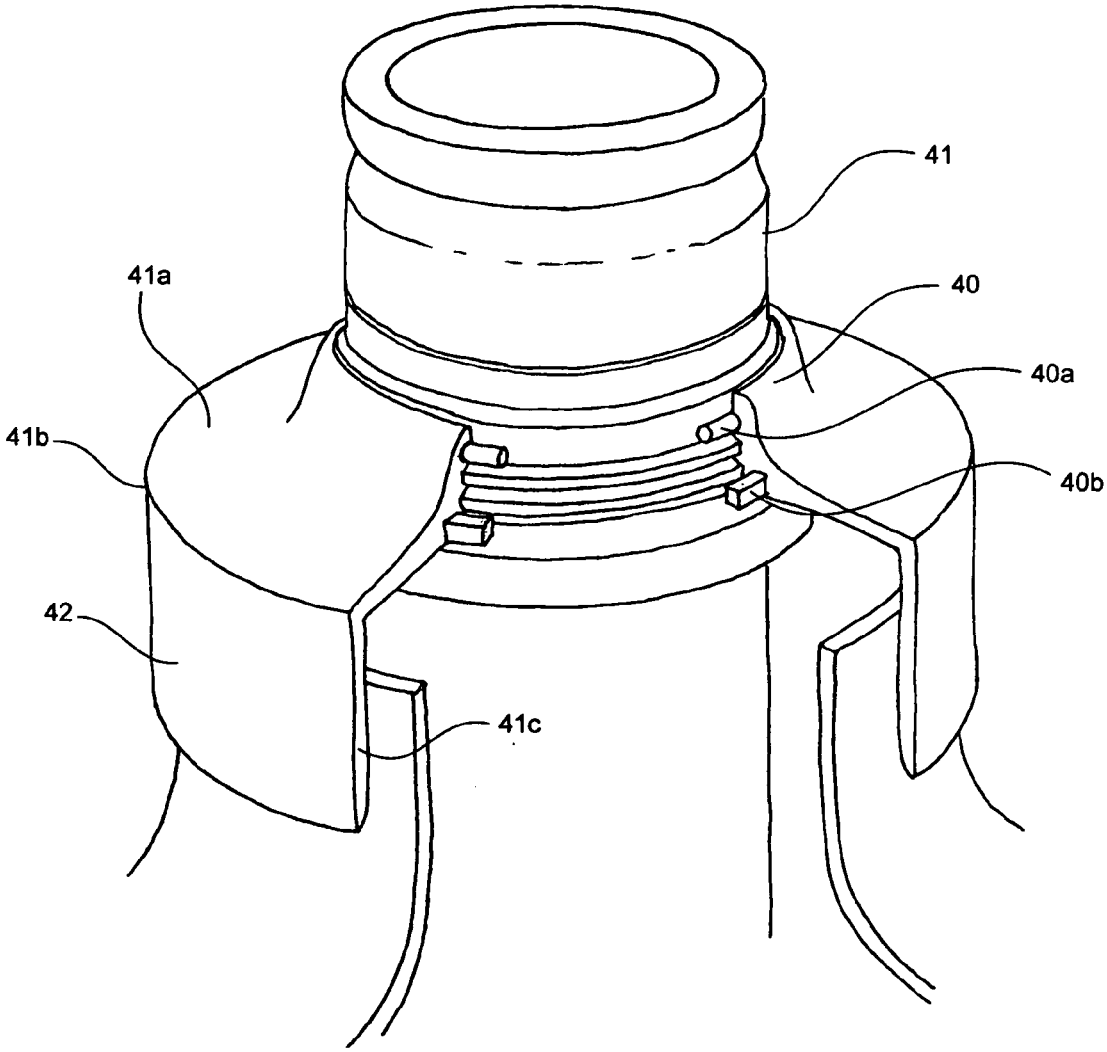
FIG. 7 is a perspective view, partly in section, of a drip cap.

Installed below the connection adaptors are drip caps 42, as depicted in FIG. 7. Each drip cap comprises a collar 40 with interior threading fitting around the connection adaptor 41. The collar flares outwardly 41*a* to form a shoulder 41*b* and then turns downwardly to form a lip 41*c*. There is a seal between the adaptor and the drip cap. Preferably, the seal is formed by an O-ring 40*a* received in a recess around the internal wall of collar 40 and a gasket 40*b* received in a downwardly facing recess such that the gasket is compressed against a flange on connection adaptor 41 when the drip cap is tightened into place. Extending laterally from the drip cap collar is a shoulder 41*b* directing any fuel running down from the adaptor into the containment reservoir. The drip caps fit over the upward protruding openings in the containment reservoir. The drip caps are also designed for removal without disassembly of the riser adaptors to assist with rapid removal of the spill containment unit.

The spill containment basin is designed to nest, as shown in FIG. 6, onto the upper edge of the tank top containment sump top hat cylinder 28*b*; however it is not attached to the top hat. This allows for rapid removal for service and maintenance of the sump and piping. The fuel fill and vapor riser drip caps are removed prior to removal of the spill containment basin. In one embodiment the capacity of the spill containment basin is at least five gallons.

Another feature of this spill containment system is that in the event of a quantity of fuel entering the spill containment basin greater than the capacity of the spill containment basin, the excess, as shown in FIG. 8 will rise up and flow over the protruding riser openings 43 and be captured by the tank top containment sump. Then fuel proximity sensors located in the sump can trigger an alarm. The outside edge 44 of the containment sump basin is sufficiently higher than the riser protrusion openings to assure that all the overflow is directed to the tank top containment sump. Preexisting spill containment systems are unable to contain a volume of fuel greater than the rated capacity, thus the excess fuel flows over the top and either onto the ground or down into the underground storage tank.

Figure 10:
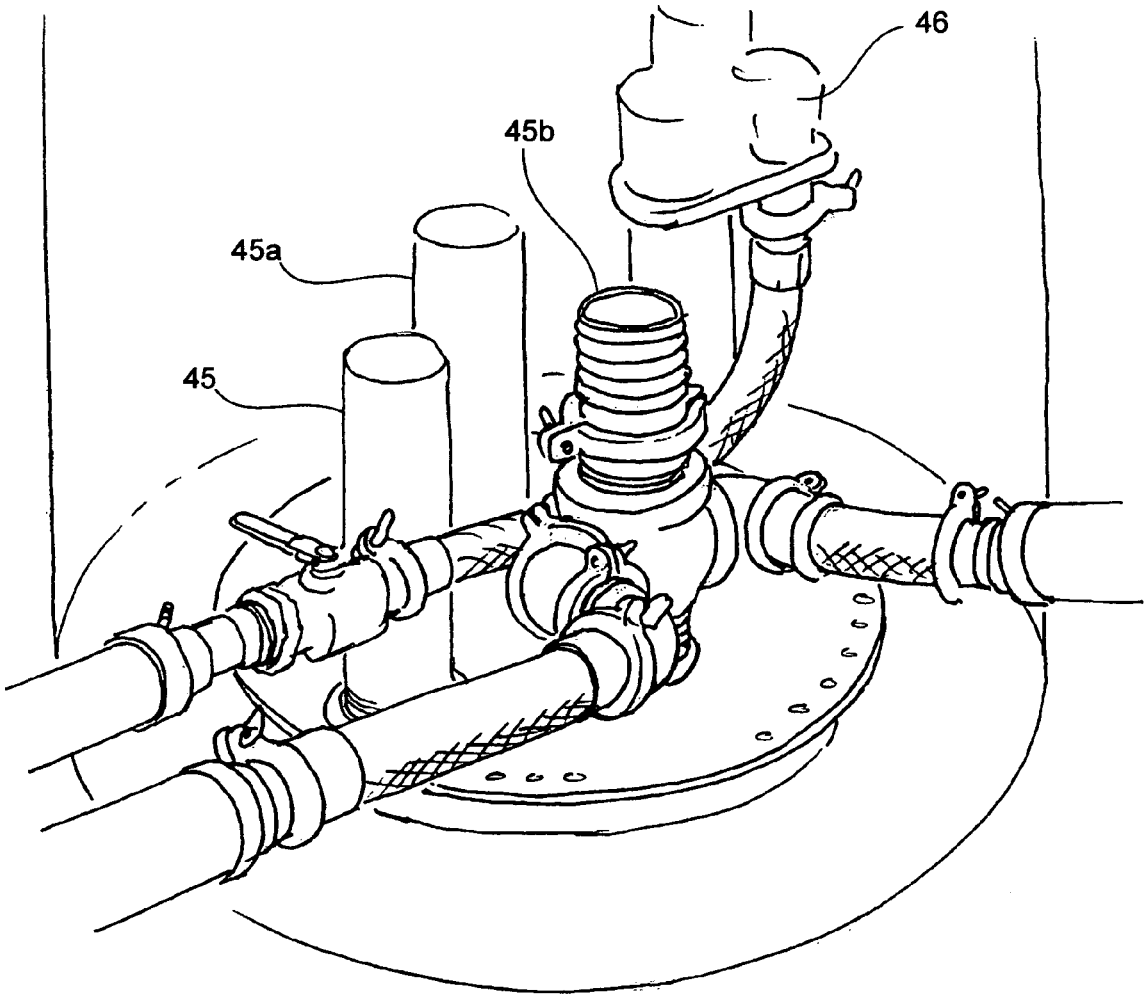
FIG. 10 is a perspective view of fuel and vapor piping.

Another feature of this spill containment system is the ability to rapidly remove the entire spill containment system (drip caps, spill containment basin, riser piping and hardware), as shown in FIGS. 9A–D. This feature makes it possible to combine all the necessary tank top connections into one tank top containment sump, as shown in FIG. 10. These items include a fill riser 45*a* and vapor riser 45*b* (both including extractor tee fittings), tank level monitor (TLM) 45 and turbine pump 46. The savings to the petroleum industry can be significant due to the elimination of one tank top containment sump and associated fittings and manways for each UST. To facilitate the installation and maintenance of the one sump containing all four items, quick connect fittings would be used for the piping connections and for various sections of the piping risers.

Another feature of this design is that the drain valve discharge is not exposed to the UST ullage vapor pressure. The drop tube is sealed at the top of the tank, as shown in FIG. 12 (please note other patent application by McGill and Wyper, U.S. Ser. No. 10/020,690, filed Oct. 29, 2001, which is incorporated herein by reference). Because the top of the drop tube 47 is sealed off from the ullage, all of the hardware and piping above that point is sealed from the ullage, similar to a p-trap or soda straw. A common failure point on ullage pressure testing of USTs is leakage from the spill containment sump drain valves. The fuel drain connection in this design is below the shutoff valve and above the drop tube seal.

Figure 14:
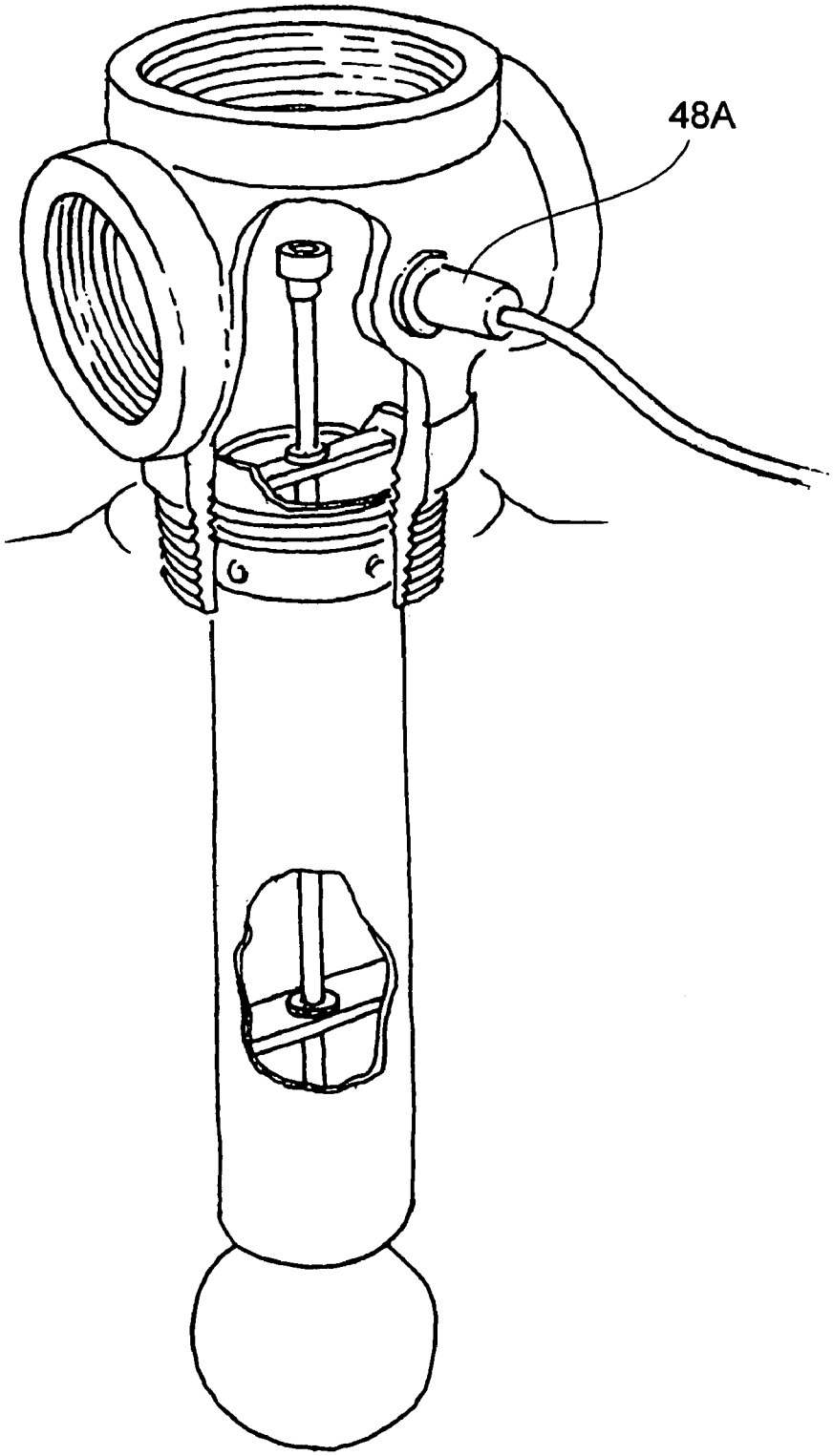
FIG. 14 is a perspective view, partly in section, of a ball float overfill protection device and sensor.

A further feature of one design of the present invention is an electronically actuated overfill protection valve on the fuel drop fill pipe and an electronically actuated valve on the vapor connection riser. These features protect the delivery driver from fuel vapor exposure and minimize fugitive emissions from the UST system. The overfill protection valve in this design serves the same function as existing overfill protection devices, namely to prevent delivery of excess fuel to the UST greater than a fixed fill percentage, typically 95%. The overfill protection system presented in this design could be triggered by the existing electronic tank level monitoring system (TLM) controller (typically a Veeder-Root TLS 350 monitoring system, which is in use at many station sites) or, as shown in FIG. 14, from a dedicated float valve sensor 48*a* integrated into the ball float unit. The valve could be configured as a fail-safe unit so that if the actuator was not connected, the valve would be closed to prevent fuel from being delivered to the tank. The valves could also be mechanically actuated.

Figure 13:
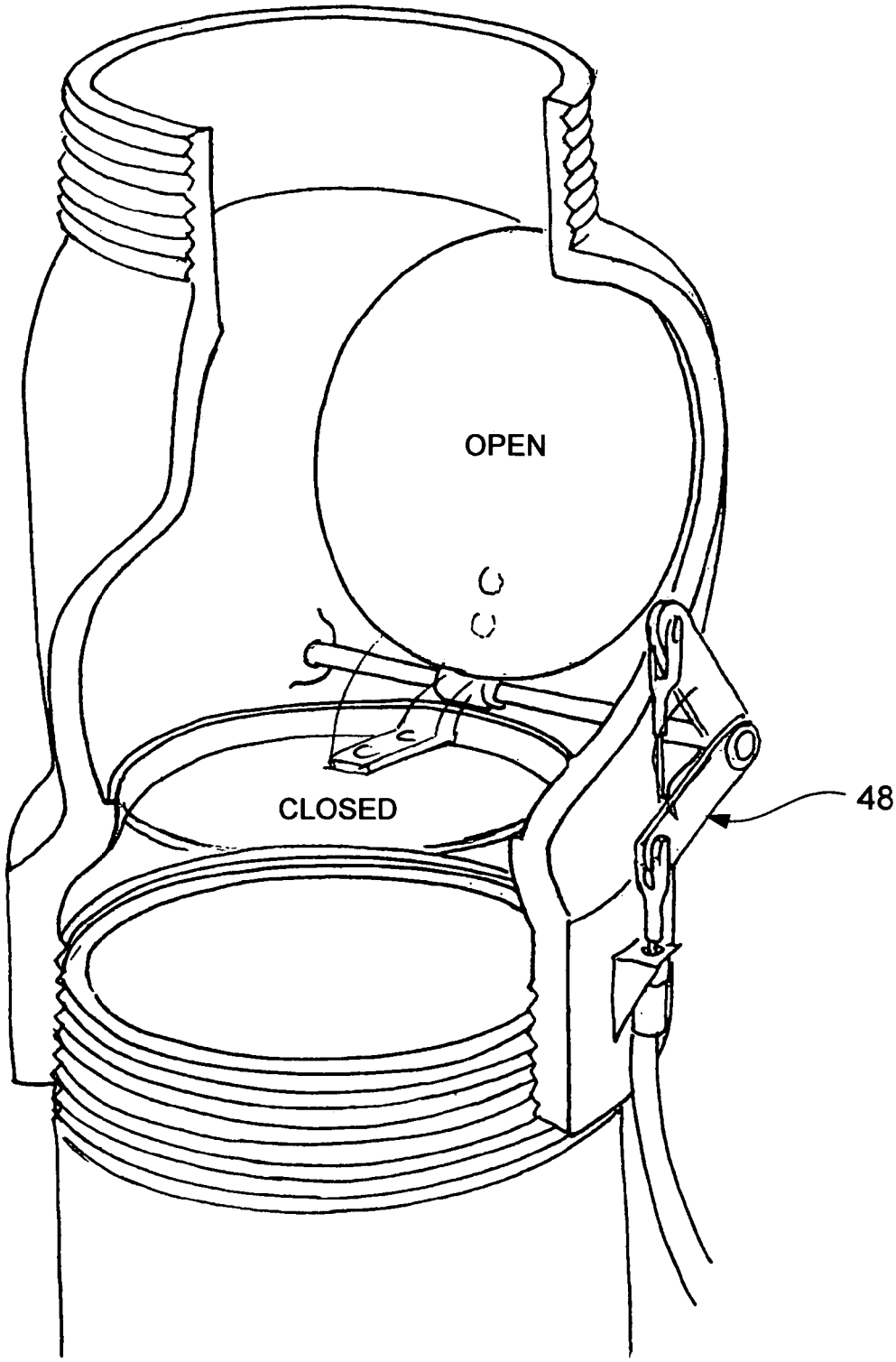
FIG. 13 is a perspective view, partly in section, of an overfill protection valve.

The overfill protection valve, as shown in FIG. 13 would normally be in the closed position 48. An electronic proximity sensor located in the vapor riser poppet valve unit would detect the connection of the vapor nozzle. After a preset time delay, the vapor and fill valves would open for fuel delivery. Both valves close immediately after the removal of the vapor nozzle or a signal from the TLM indicating the fuel level in the UST is greater than permitted. Also, the time delay opening the vapor valve permits the delivery driver to connect the vapor nozzle without exposure to the UST ullage fuel vapor pressure because the driver is connecting the nozzle to a closed valve. Again, these valves could be mechanically actuated.

Prior to filling the UST, the fuel delivery driver must manually gauge the UST with a tank gauge stick. This can be facilitated by pushing a special "TANK STICK" button on the control system console located in the station. This may also be facilitated by attaching the vapor nozzle first, which after the time delay will open both valves and allow a gauge stick to be inserted into the fill pipe to measure tank level. The fill valve will automatically close several minutes after the "TANK STICK" button is activated unless the vapor nozzle is connected.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention. Accordingly, the foregoing description should not be read as pertaining only to the precise structures described and illustrated in the accompanying drawings. Rather, it should be read consistent with, and as support for, the following claims which are to have their fullest scope.

What is claimed is:

1. A containment system for a fuel site comprising:

a fuel storage tank;

at least one fuel line connected to the fuel storage tank;

a containment sump associated with the fuel storage tank and encircling the at least one fuel line connected to the fuel storage tank;

an opening in the containment sump through which external connections may be made with a remote end of the at least one fuel line; and an unattached, removable catch basin adapted to fit into the opening in the containment sump and to fit over and around the remote end of the at least one fuel line such that the catch basin can catch fuel spills from the remote end of the at least one fuel line.

2. A containment system according to claim 1 wherein the at least one fuel line comprises a fuel fill line.

3. A containment system according to claim 1 where the at least one fuel line comprises a vapor return line.

4. A containment system according to claim 1 where the at least one fuel line comprises a fuel fill line and a vapor return line.

5. A containment system according to claim 1 also comprising a removable drip cap placed over and around the at least one fuel line and extending between the at least one fuel line and the unattached, removable catch basin such that fuel cannot drip down between the at least one fuel line and the unattached, removable catch basin into the containment sump.

6. A containment system according to claim 5 wherein the unattached, removable catch basin also comprises a drain and a drain line connected to the at least one fuel line.

7. A containment system according to claim 6 wherein the drain also comprises a drain valve that can be actuated by an operator.

8. A containment system according to claim 7 wherein the drain valve is foot operated.

9. A containment system according to claim 6 wherein the drain line is a flexible line.

10. A containment system according to claim 6 wherein the only connections of the system to the at least one fuel line are at the removable drip cap and at the drain line.

11. A containment system according to claim 10 wherein the connections of the system to the at least one fuel line are removable.

12. A containment system according to claim 11 wherein the connections of the system to the at least one fuel line are threaded connections.

13. A containment system according to claim 1 wherein the only connections of the system to the at least one fuel line are removable.

14. A containment system according to claim 1 wherein the at least one fuel line contains a 3A type sanitary fitting such that a portion of the fuel line may be removed for easier access to the containment sump.

15. A containment system according to claim 1 wherein the unattached, removable catch basin is made in one piece.

16. A containment system according to claim 1 wherein the fuel storage tank is an underground storage tank.

17. A containment system according to claim 16 wherein the containment sump is a tank top containment sump.

18. A containment system according to claim 1, wherein the unattached, removable catch basin is removable by merely lifting the unattached, removable catch basin.

19. A containment system for a fuel site comprising:

a fuel storage tank;

at least one fuel line connected to the fuel storage tank;

a containment sump associated with the fuel storage tank and encircling the at least one fuel line connected to the fuel storage tank;

an opening in the containment sump through which external connections may be made with a remote end of the at least one fuel line; and a removable catch basin adapted to fit into the opening in the containment sump and to fit over and around the remote end of the at least one fuel line such that the catch basin can catch fuel spills from the remote end of the at least one fuel line;

wherein a fuel turbine is also enclosed within the containment sump.

20. A containment system for a fuel site comprising:

a fuel storage tank;

at least one fuel line connected to the fuel storage tank;

a containment sump associated with the fuel storage tank and encircling the at least one fuel line connected to the fuel storage tank;

an opening in the containment sump through which external connections may be made with a remote end of the at least one fuel line;

a removable catch basin adapted to fit into the opening in the containment sump and to fit over and around the remote end of the at least one fuel line such that the catch basin can catch fuel spills from the remote end of the at least one fuel line; and a removable drip cap placed over and around the at least one fuel line and extending between the at least one fuel line and the removable catch basin such that fuel cannot drip down between the at least one fuel line and the removable catch basin into the containment sump;

wherein the removable drip cap is threaded onto an outer surface of the at least one fuel line.

21. A containment system for a fuel site comprising: means for storing fuel;

at least one means for communicating fuel to the means for storing fuel;

means for containment associated with the means for storing fuel and encircling the means for communicating fuel;

means through which external connections may be made with a remote end of the means for communicating fuel; and unattached, removable means for fitting into the means through which external connections may be made and fitting over the remote end of the at east one means for communicating fuel such that the removable means can catch fuel spills from the remote end of the at least one means for communicating fuel.

22. A containment system for a fuel site comprising:

a fuel storage tank;

at least one fuel line connected to the fuel storage tank;

a containment sump associated with the fuel storage tank and encircling the at least one fuel line connected to the fuel storage tank;

an opening in the containment sump through which external connections may be made with a remote end of the at least one fuel line;

a removable catch basin adapted to fit into the opening in the containment sump and to fit over and around the remote end of the at least one fuel line such that the catch basin can catch fuel spills from the remote end of the at least one fuel line; and a removable drip cap placed over and around the at least one fuel line and extending between the at least one fuel line and the removable catch basin such that fuel cannot drip down between the at least one fuel line and the removable catch basin into the containment sump;

wherein the removable catch basin comprises an upwardly extending side wall, and an upwardly extending inner wall lower than the side wall that encircles but is spaced from the at least one fuel line, and wherein the removable drip cap extends from the at least one fuel line over the inner wall of the catch basin but is spaced from a top edge of the inner wall such that fuel filling the catch basin can drain into the containment sump.

23. A containment system according to claim 21, wherein the unattached, removable means is removable by merely lifting the unattached, removable means.

24. A containment system for a fuel site comprising:

a fuel storage tank;

at least one fuel line connected to the fuel storage tank;

a containment sump associated with the fuel storage tank and encircling the at least one fuel line connected to the fuel storage tank;

an opening in the containment sump through which external connections may be made with a remote end of the at least one fuel line; and a removable catch basin adapted to fit into the opening in the containment sump and to fit over and around the remote end of the at least one fuel line such that the catch basin can catch fuel spills from the remote end of the at least one fuel line;

wherein the removable catch basin is removable without the use of tools.

* * * * *